US007207197B2

(12) United States Patent
North

(10) Patent No.: US 7,207,197 B2
(45) Date of Patent: Apr. 24, 2007

(54) WASHING AND DRYING MACHINES AND DRY-CLEANING MACHINES

(76) Inventor: John Herbert North, 21 Briar Court, Guardian Road, Norwich, Norfolk, NR5 8PR (GB)

( * ) Notice: Subject to any disclaimer, the term of this patent is extended or adjusted under 35 U.S.C. 154(b) by 0 days.

(21) Appl. No.: 10/961,010

(22) Filed: Oct. 8, 2004

(65) Prior Publication Data

US 2005/0092032 A1 May 5, 2005

Related U.S. Application Data

(62) Division of application No. 09/936,635, filed on Sep. 12, 2001, now Pat. No. 6,849,094.

(51) Int. Cl.
*D06F 37/02* (2006.01)

(52) U.S. Cl. ..... 68/5 C; 68/59; 68/207

(58) Field of Classification Search ..... 68/5 C, 68/59, 205 R, 207; 8/142, 149.1, 149.3, 8/159

See application file for complete search history.

(56) References Cited

U.S. PATENT DOCUMENTS 2,335,560 A * 11/1943 Crane et al. ..... 68/21
4,489,455 A * 12/1984 Spendel ..... 8/158
5,768,730 A * 6/1998 Matsumoto et al. ..... 8/159

* cited by examiner

*Primary Examiner*—Joseph L. Perrin
(74) *Attorney, Agent, or Firm*—Barnes & Thornburg

(57) ABSTRACT

A machine for washing and/or cleaning articles comprises a sealable enclosure for containing the articles to which cleaning liquid is to be supplied. The cleaning liquid is heated to a high temperature and forced into the enclosure under high pressure as finely dispersed or diffused droplets forming a mist or vapour. A pressure greater than atmospheric is maintained in the enclosure to force the cleaning liquid into at least the surface if not through and into the very structure of the material from which the articles are formed, so as to assist the cleaning process by producing a quicker and more efficient saturation of the articles by the cleaning liquid. The latter may comprise water and detergent or a dry-cleaning solvent. The cleaning liquid is removed from the articles and the interior of the enclosure by means of a suction pump. If a rinse is required, it is replaced by clean liquid for rinsing, preferably also at higher than atmospheric pressure and if desired also heated to higher than ambient temperatures. The rinsing liquid is also removed from the enclosure by suction. The suction is obtained by a suction pump typically a venturi vacuum pump and this is also employed to create a partial vacuum in the enclosure during a drying phase after the cleaning and, if desired rinsing stages.

5 Claims, 10 Drawing Sheets

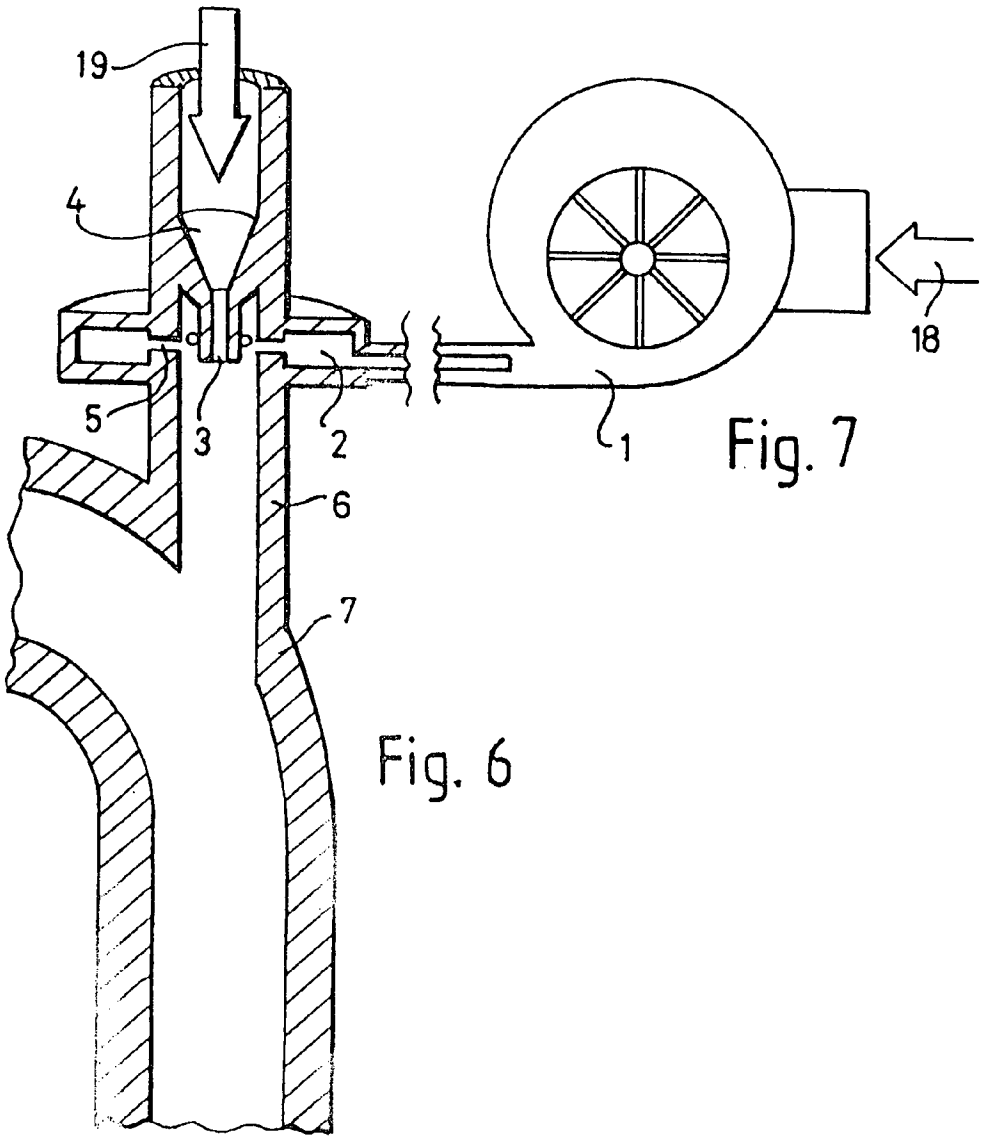
Fig. 7
Fig. 6
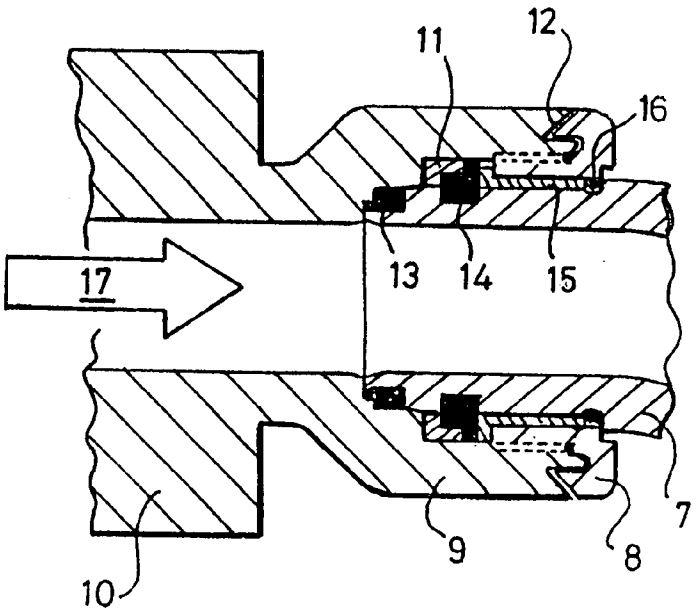
Fig. 5

WASHING AND DRYING MACHINES AND DRY-CLEANING MACHINES

RELATED APPLICATION

This application is a division of U.S. patent application Ser. No. 09/936,635, filed Sep. 12, 2001 now U.S. Pat. No. 6,849,094.

FIELD OF INVENTION

This invention concerns machines for washing and drying articles such as clothes, bed-linen, curtains, towels and the like and machines by which such articles can be dry-cleaned. Articles which can be so washed/dried and/or dry-cleaned are hereinafter simply referred to as articles.

BACKGROUND TO THE INVENTION

Existing machines tend to comprise a rotary drum mounted within a housing. Access to the drum for loading and unloading articles to be washed/cleaned is via a top opening lid or front opening door.

Water and detergent is pumped into the drum and the latter is rotated so as to agitate the articles and thoroughly saturate articles with the detergent solution. The articles are then rinsed using clean water and finally are dried by spinning the drum at high speed so as to force moisture out of the articles under centrifugal force and by blowing heated air through the articles in the drum as the latter is rotated more slowly.

In a similar way dry-cleaning is achieved by introducing an appropriate volatile solvent into the drum and rotating the latter whilst in closed condition so as to saturate the articles with the solvent. The spin drying step is not normally called for and the solvent is removed from the articles by blowing hot air through the drum. By virtue of the odour and possibly harmful effects of breathing in the solvent vapour, the latter is normally separated from the exiting vapour laden air, and collected before the air is released from the machine.

In the case of a washing machine the process tends to use large quantities of water and energy and a typical washing and drying cycle can be as long as 120 to 250 minutes.

It is an object of the present invention to provide apparatus that can be used for washing and drying articles in a shorter time-scale and with reduced energy requirements and which can be used with minor modification for dry-cleaning articles using an appropriate dry-cleaning solvent.

The detergent solution or the dry-cleaning solvent used to saturate the articles to wash or dissolve away dirt, will hereinafter simply be referred to as the cleaning liquid.

SUMMARY OF THE INVENTION

According to one aspect of the present invention in a machine for washing and/or cleaning articles and which comprises a sealable enclosure for containing the articles to which cleaning liquid is to be supplied, the cleaning liquid is heated to a high temperature and forced into the enclosure under high pressure as finely dispersed or diffused droplets forming a mist or vapour so that a pressure greater than atmospheric is maintained in the enclosure to force the cleaning liquid into at least the surface if not through and into the very structure of the material from which the articles are formed, so as to assist the cleaning process by producing a quicker and more efficient saturation of the articles by the cleaning liquid.

According to another aspect of the invention cleaning liquid is removed from the articles and the interior of the enclosure by means of a suction pump and replaced by clean liquid for rinsing, preferably also at higher than atmospheric pressure and if desired also heated to higher than ambient temperatures.

By supplying rinsing liquid at higher than atmospheric pressure and preferably in the form of a mist or vapour, so the rinsing liquid will also be forced into at least the surface if not into the very structure of the material from which the articles are made.

According to another aspect of the invention the rinsing liquid may also be removed from the enclosure by suction.

According to a further aspect of the invention, during a drying cycle following a rinsing cycle suction is employed to reduce the pressure on the downstream side of the enclosure substantially below atmospheric, so that evaporative drying of liquid remaining on or in the material from which the articles are formed, occurs, and vapour laden air produced by the evaporation is removed from the enclosure by the scavenging action of the air being drawn from the enclosure under the suction.

It has been found that a suction assisted drying cycle can dry articles to a satisfactory level of dryness, without the need for the application of heat. This substantially reduces the energy requirement of the drying cycle.

It has also been found that a suction assisted drying cycle can dry articles to a satisfactory level of dryness without the need to centrifugally remove the moisture from the wet articles by spin-drying. This again saves the energy that would otherwise be needed to rotate the enclosure at high speed to achieve centrifugal drying and can also reduce the size ie power of the drive motor for the enclosure since it is no longer required to rotate-the enclosure at high spin speeds.

It has also been found that the liquid saturating stage of a washing or dry-cleaning, cycle can also be performed without the addition of substantial quantities of heat. Where this is the case the energy otherwise needed to heat the enclosure and articles and liquid on and/or in the articles, is no longer required.

Even where heat is required to raise the temperature of the enclosure, articles and cleaning liquid, the pressurised article saturation process is so much more efficient at permeating the articles and releasing dirt particles than when carried out at atmospheric pressure, that the volume of liquid to be heated tends to be less, and/or the time during which the heat has to be applied is much shorter, than in a conventional process, and again significant energy saving can be achieved.

The enclosure may comprise a rotatable drum, with a drive means for rotating the drum when in use and inlet and outlet means permitting relative movement to enable liquid and air to be supplied to and drawn off therefrom whilst the drum is rotating.

Alternatively the enclosure may comprise a housing within which a rotatable drum is mounted and liquid and air can be forced into and out of the drum axially and/or radially through openings, typically a large number of small apertures such as perforations in the wall of the drum, and in one embodiment the air and liquid mixture may be forced into the drum in a radial sense from the space around the drum within the housing, and be collected and conveyed away from the drum via a central porous or apertured hollow sleeve, mounted axially and centrally within the drum.

The housing may form part of the drum and rotate therewith, or be stationary so as to simplify the air and liquid supply to, and drainage from, the drum.

The invention is of particular application to domestic as well as commercial and industrial washing machines.

The invention also lies in apparatus for performing the various aspects of the invention.

Since the apparatus remains little changed for allowing a dry-cleaning process to take place, the invention also provides apparatus that can be used for washing and drying, or dry-cleaning, articles.

In apparatus as aforesaid the above atmospheric air pressure is preferably obtained using an impeller or turbine or more preferably a centrifugal air pump, and the suction to produce depressed pressures below atmospheric is preferably obtained using a venturi vacuum pump.

A preferred venturi pump is a dual conical venturi jet high vacuum pump capable of generating a suction equivalent to 760 mm Hg. However it is to be understood that the invention is not restricted to the use of any particular type of pump.

Preferably a filter or the like is provided at the inlet to the enclosure and liquid is finely dispersed and/or diffused on entry into the enclosure by forcing it therethrough.

The liquid may to advantage be mixed with air both at elevated pressure and if desired elevated temperature before being forced under pressure, or by suction due to vacuum, through the inlet filter.

The filter may be a fine mesh filter.

In a preferred embodiment the enclosure is in the form of an elliptical capsule mounted for rotation about an axis through the mid-point of the longer axis perpendicular to the latter and comprising a diameter of the cylindrical mid-region of the capsule so that articles located therein will tend to fall from one end to the other as the capsule is rotated and thereby assist in the mixing of the liquids introduced into the capsule during the washing or cleaning process and to agitate the articles excessively during the drying cycle to further assist in removing moisture therefrom.

Where the capsule is to be loaded and unloaded through a circular opening in the front wall of a rectangular housing within which the capsule is located for rotation, and wherein the opening in the front housing wall is normally closed by a hinged circular door, the front opening (and in consequence the door also), is preferably arranged coaxially relative to the axis of rotation of the capsule, and the capsule includes a circular opening which aligns with the circular front housing opening, and an annular seal is provided between the two openings to enable a positive pressure to be maintained in the capsule after the door has been closed.

Preferably a double door assembly is provided one closing an opening in the capsule wall and the other the opening in the front wall of the housing.

Preferably a seal is provided around each said door to seal it against the opening in the capsule wall, or the opening in the front housing wall, respectively.

Valve means is preferably provided to control the admission of liquid and air to the capsule after the openings have been sealingly closed.

Typically the valve means comprise solenoid valves.

The capsule is typically mounted for rotation by two rotary support bearing assemblies, one surrounding the loading and unloading opening and the other attached to a diametrically opposite region of the cylindrical wall of the mid-region of the capsule coaxial with the first bearing assembly.

The second bearing assembly surrounds a circular region in the capsule wall opposite to the loading and unloading opening, and concentric pipe means having a rotary seal with the wall of the capsule, enables the capsule to rotate whilst still being connected to the liquid and air supplies and also allows liquid and air to enter the capsule whilst the latter rotates.

The pipe means may communicate with one or more fine mesh filters to disperse and diffuse the incoming high pressure liquid and air into a fine mist.

In a preferred embodiment the valve means controlling the passage of liquid and air into the capsule may be arranged adjacent the pipe means where it extends through the capsule wall and may be attached to or form part of the capsule wall.

The pipe means and valve may be surrounded by and extend axially through a hollow cylindrical drive shaft carrying a large diameter pulley which shaft extends through a support bearing assembly at the rear of the capsule and is joined to the capsule wall. A motor, typically an electric motor, whose output shaft carries a complementary pulley aligned with the first mentioned pulley, allows drive to be transmitted to the drive shaft from the motor via a drive band, to rotate the capsule about the support bearing axis.

The bearing assembly may be a solid ring or a so-called split bearing, and is mounted on a sub-frame within the housing.

In one arrangement the opposite ends of the capsule include sieve-type filters and the pipe means deliver liquid and air to the two filters to enter the interior of the capsule from opposite ends thereof.

In another arrangement a hollow cylindrical sleeve extends across the interior of the capsule coaxial with the aligned support bearing axes which define the axis of rotation of the capsule and the sleeve wall is perforated with tiny apertures through which the liquid and air exit into the interior of the capsule as a fine mist diffused by the tiny perforations which form a cylindrical fine mesh sieve type filter.

The fine mesh filter allows the incoming pressurised liquid and air to diffuse into the articles and produce a fast gaseous reaction inside the capsule due the liquid gaining heat energy by virtue of the liquid being forced through the plurality of tiny openings making up the filter mesh. It has been observed that this gives a sprinkler jet action for the gas-liquid mixture and yields excellent gaseous state cleaning particularly in the case of a washing machine where the liquid is water mixed with detergent.

A particularly preferred arrangement in the case of a washing machine involves a heater to heat the water to boiling point so that at least part of the liquid entering the capsule is in the form of steam vapour.

The preferred shape of the capsule ensures that articles and liquid are tumbled from one end to the other under gravity as the capsule is rotated.

If it can be arranged that the air expands due to its being heated after coming into contact with the steam, a further increase in pressure within the capsule will result causing the detergent suds to more thoroughly permeate the articles particularly where the latter are formed from woven fabric, so further assisting the release of dirt and particles causing stains and marks in the fabric.

In the case of a washing machine for washing garments and other fabric articles, the strong suction coanda effect gathers the garments around the central sleeve.

In the case of a top loading machine it has been found preferable to extract the liquid and air from the end of the capsule opposite to the end containing the sealable opening through which access can be gained to the interior of the capsule, so that the garments tend to gravitate towards the end opposite to the opening under the suction effect, and in this way the weight of the garments at that end will tend to ensure that the capsule will always come to rest with its end containing the access aperture uppermost and in alignment with an opening in the housing surrounding the capsule which in use will normally be closed by a lid.

The vacuum induced suction within the capsule not only produces a fast dehydration of the moist articles within its interior, so enhancing the drying process and doing so without the application of hat energy, but also particles and fibres are all sucked out of the capsule and there is no need for filters, screens or strainers in the outlet which in a conventional washing machine regularly have to be cleaned out.

The invention has permitted the drying time for a specimen 5 Kg load to be reduced from 120 minutes in a conventional washer-drier operating in tumble-dry mode to between 1 and 2 minutes.

In a preferred embodiment of the invention in the form of a washing machine, the venturi suction pump creates a pressure drop equivalent to 760 mm Hg., a pump supplies water to the venturi at between 150 and 300 psi (the latter for industrial applications and the former for domestic applications), and optimum operation is obtained when the ambient pressure is 14.72 psi., since it has been found that an increase in pressure can result in cavitation within the flow which reduces the suction from typically 760 mm to 300 mm Hg.

The pump may be a centrifugal or positive displacement pump.

A three port conduit high vacuum venturi pump is preferred.

In a preferred vacuum pump the venturi tube includes peripheral air duct set around the outside of the venturi outlet and this arrangement accelerates with flow. The venturi tube is connected to a branch inlet at the mid point of a 90 degree radius bend radius relative to the centreline of the tube o/d to provide a strong vacuum suction. The centrifugal pump delivers water through the venturi supply tube and a centrifugal air blower outlet is connected via a pipe to the peripheral air chamber to control the air flow around the venturi, which in turn controls the amount of the suction.

Preferably an air pressure relief valve is provided which also controls the amount of suction created.

Preferably the vacuum the temperature and the pressure are displayed in an analogue or digital display (preferably an analogue LCD bar display) on the front of the machine housing.

The user is then able to see which of the programmes has been reached and to control conditions as required in addition to operating the conventional washing machine controls.

Advantages of a washing machine embodying the invention are inter alia:

1. Smaller electric motor and lower drive speeds for the drum capsule, so less wear and tear on the machine bearings and shock absorbing mountings.
2. Low. water consumption relative to a conventional washing machine process eg 23 litres for a 5½ Kg load.
3. Variable temperature short duration wash, rinse and drying cycles. Washing has been accomplished in 3 to 5 minutes, rinse cycle time has been as low as 1 minute and vacuum assisted drying has been down to 1 to 2 minutes. A high pressure crease guard rinse cycle can be automatically incorporated.
4. Gentle rotation means less wear on fabrics.
5. No heat drying allows very delicate temperature sensitive fabrics to be handled.
6. A machine embodying the invention can give a superior wash and dry to the present class A wash and dry specification irrespective of load weight.
7. The efficient permeation under pressure of fabrics by the liquids during washing and the vacuum assisted drying without the need for heat saves water, electricity and detergent.
8. The lack of heating garments during drying results in less likelihood of wear and tear and shrinkage.
9. Low electrical energy consumption. 400 washes per year using current washing machine technology would use 2216 kWh per year which at £.07 per kWh means a cost of £156. The present invention would allow 400 similar wash cycles using a washing machine embodying the present invention would use in the range of 130 to 208 kWh per year at a cost of between £9 and £14.60, giving a saving of 96% in energy costs.
10. Minimal vibration and light weight due to the absence of heavy balancing masses.

The invention provides novel and advantageous combinations of features as follows:

A. A method is claimed for the use of a capsule type washing drum (of any 7 shape) with a pressurised door. with the axis of the capsule perpendicular to the axis of rotation, which is midway along the capsule.

B. A method as claimed for the use of one or two end sieve type filters, with vacuum ducts or an internal central filter with fine holes or sieve type mesh filter screen to increase the acceleration and the gaseous content of the gas and liquid mixture as it enters the capsule. The single end filter inside the capsule, enables the capsule drum, top loader always to stop in the vertical upright plane, and the central filter will also stop the capsule in the horizontal plane.

C. A method is claimed for the use of a transparent dual rotating inner door connected to a stationary outer door, connected to a central member, for sealing against the cylindrical inner seal that is set inside the laundry, loading aperture of the axial drive shaft or the capsule washing drum.

D. A method is claimed for the use of a venturi type vacuum pump in a washing or drying machine. For emptying the washing liquid, rinsing water and for removing water and moisture from the garments.

E. A method is claimed for the use of an air pump to control suction strength in conjunction with a venturi type jet pump. This provides for some moisture to remain within the garments, if so required.

F. A method is claimed for the use of a mechanical/rotary driven capsule type washing drum, front loading or top loading, with or without a vacuum drying system.

G. A method is claimed for the use of a capsule type drum as disclosed within the Patent for the use as a dry cleaning unit.

H. A method is claimed for the use of a rotary swivel drive joint, with a delivery and discharge solenoid operated multi port valve (not shown) for use with a pressure capsule washing drum machine.

I. A method is claimed for the use of a drive belt or gearing to rotate the capsule washing drum.

J. A method is claimed for the use of a LCD or similar bright bar type displays as disclosed within the Patent.

K. A method is claimed for the use of a separate heater tank as disclosed within the Patent or a combined inner and outer shell capsule as the heater tank.

L. A method is claimed for the use a single lower sieve type filter screen and an internal type conduit to draw the vacuum within a top loading capsule washing drum, the garments inside would always drop to the bottom of the capsule by gravity, due to suction the moment the vacuum cycle starts, this will always place the loading aperture to the top of the machine, in the vertical upright plane.

M. A method is claimed for the use of any type of sealing arrangement which can be used to provide a pressure seal between the inner rotating transparent glass door and the capsule washing drum as disclosed within the Patent.

Fluid flow in the various flow and return lines is preferably controlled via solenoid outlet valves.

Functions are preferably controlled by a programmable control unit such as a programmable line computer (PLC).

A typical washing and rinsing cycle comprising the following steps:

1. Load powder or liquid detergent.
2. Load capsule with articles to be washed (the wash load).
3. Supply cold and hot water typically a gravity feed to a heating tank via solenoid valve means, where it is mixed with a detergent.
4. Heat the mixture to the required temperature (typically of the order of 40, 50, 60 or 90 degrees centigrade).
5. Pump the heated mixture into the capsule through a rotary joint assembly and through an internal fine filter, causing diffusion of the liquid for a fast gaseous reaction inside the capsule. The solution becomes heated as it is forced through the apertures in the filter resulting in a sprinkler jet action.
6. In conjunction with step 5, the capsule is rotated at approximately 80 rpm except during the emptying of the wash and rinse/drying cycles.
7. At the end of the washing cycle all the washing fluid is sucked from the capsule by a venturi pump.
8. After the rinse cycle starts, cold water under the supply pressure is supplied to the capsule from the cold water supply. Typically this entails supplying cold water from the mixing compartment.
9. At he end of the rinse cycle, spend rinse water is removed by suction using the venturi pump.

Typically using the invention to wash a load weighing approximately 5.5 kgs requires 7.5 litres of water and 6 tablespoons of low foaming powder or liquid detergent.

According to another aspect of the present invention, the capsule may be used for dry cleaning by introducing a volatile cleaning fluid such as isopropyl alcohol into the capsule with one or more items of clothing or the like which are to be dry cleaned, sealing the capsule so as to provide a gas-tight compartment, rotating the capsule in the range 80–100 rpm and prior to unsealing the capsule to remove the clothing or like articles, extracting vapours and gases left over from the cleaning process by operating the suction pump.

The invention will now be described by way of example, with reference to the accompanying drawings, in which:

FIG. 5 shows a schematic sectional view of a rotary swivel joint connected to the vacuum venturi pump;

FIG. 6 shows a diagrammatic view partially in section of a venturi vacuum jet pump;

FIG. 7 shows a schematic of a centrifugal pump for suction control;

Figure 1:
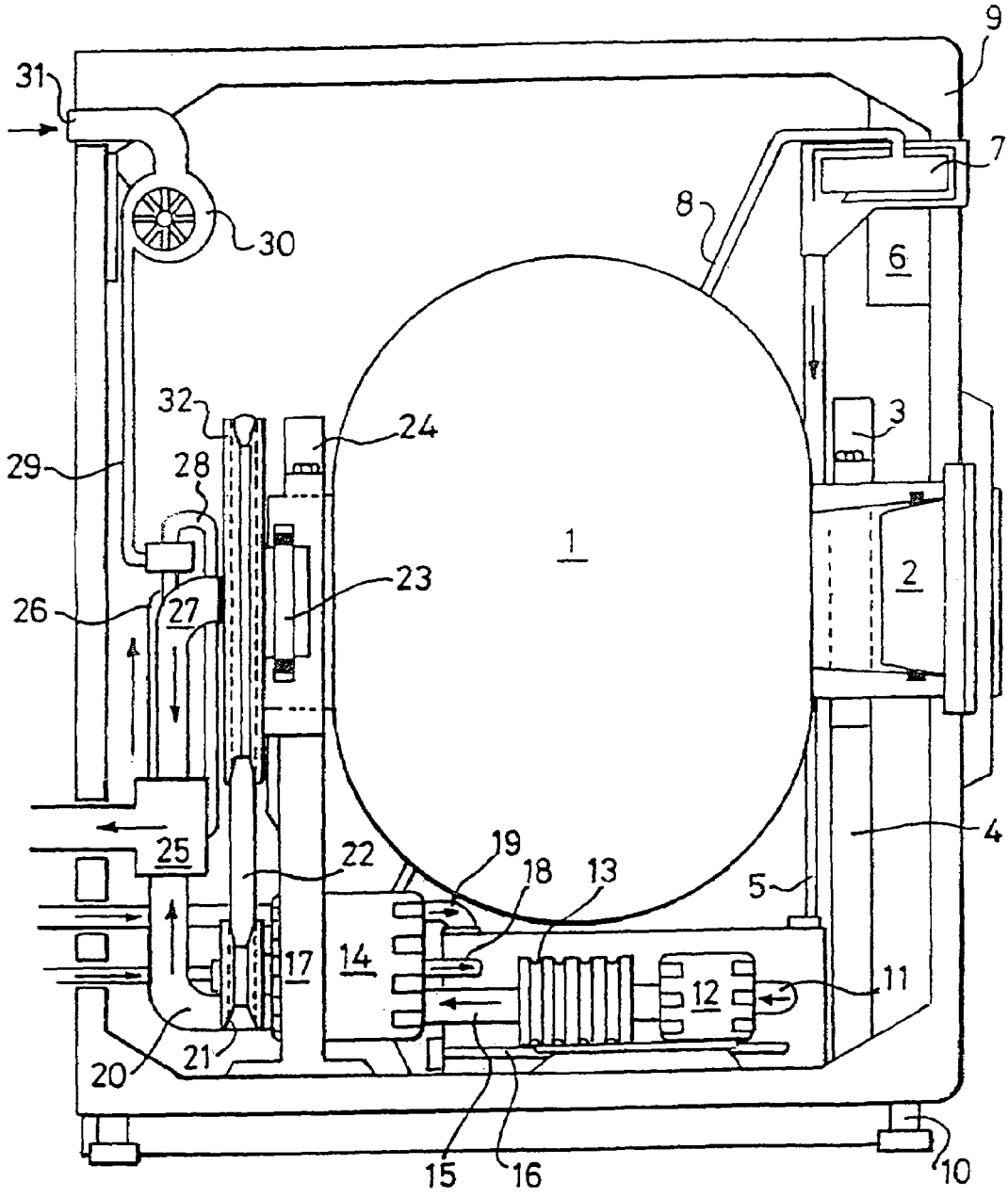
FIG. 1 shows a side elevation view partially in section of a capsule washing drum front loading machine.

FIG. 1 is a side elevation view partially in section of a capsule washing drum machine and illustrates the disclosed preferred embodiment of the apparatus assembled in accordance with the present invention for washing and drying garments. Showing outer cabinet shell Item 9, adjustable levelling feet Item 10, capsule washing drum Item 1, dual rotary transparent glass door Item 2, bearing block retaining axial drive shafts Item 3, and 24, support frame for capsule drive shafts item 4, and 17, water and detergent supply tube to heater tank item 5, water heater Item 16, controls Item 6, detergent drawer Item 7, water supply to drawer Item 8, suction inlet to pump for heater tank Item 11, electric motor Item 12, drives water-detergent pump Item 13, water-detergent supply tube item 16, 26, and 20, to control valve and drain outlet Item 25, for supply to the capsule washing drum through the solenoid valve-rotary swivel joint Item 23, vacuum tube Item 27, venturi tube Item 28, air supply tube Item 29, centrifugal air motor/pump Item 30, air inlet to pump item 31, electric drive motor and reduction gearing Item 14, motor drive pulley Item 21, capsule washing drum drive pulley Item 32, drive belt Item 22, hot water in Item 19, cold water in Item 18.

Figure 2:
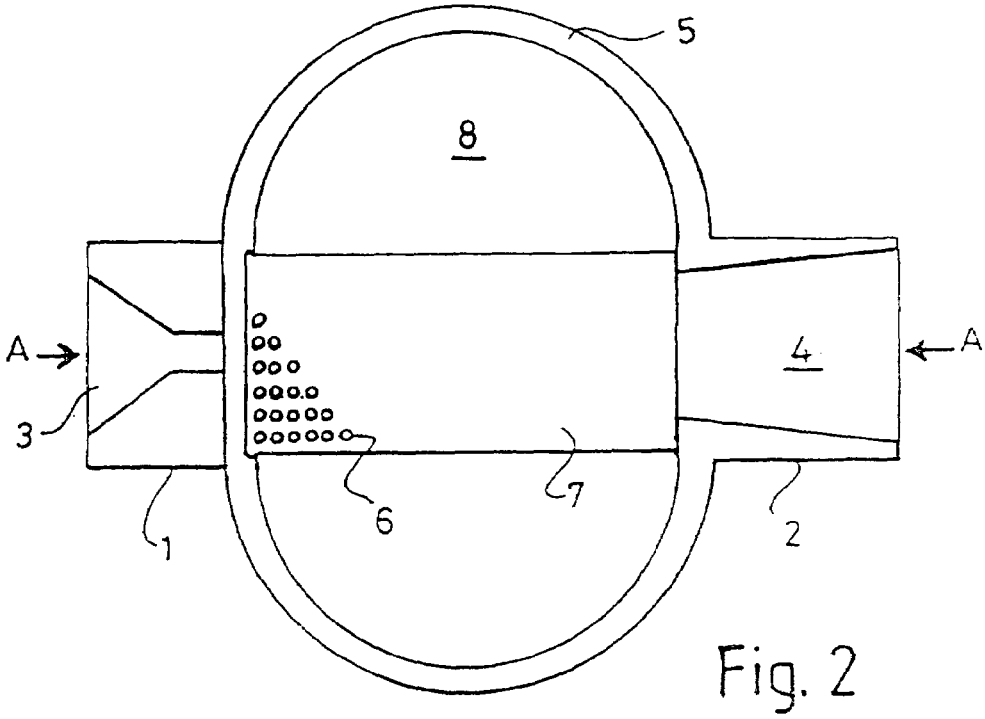
FIG. 2 shows a top longitudinal elevation view partially in section of a capsule washing drum.

FIG. 2 discloses a top longitudinal elevation view partially in section of a capsule washing drum showing axial drive shaft side Item 1, loading side Item 2, supply and suction ports Item 3, washing inlet Item 4, wall of capsule Item 5, fine sieve type perforations Item 6, in the central filter sleeve Item 7, inside capsule washing drum item 8.

Figure 3:
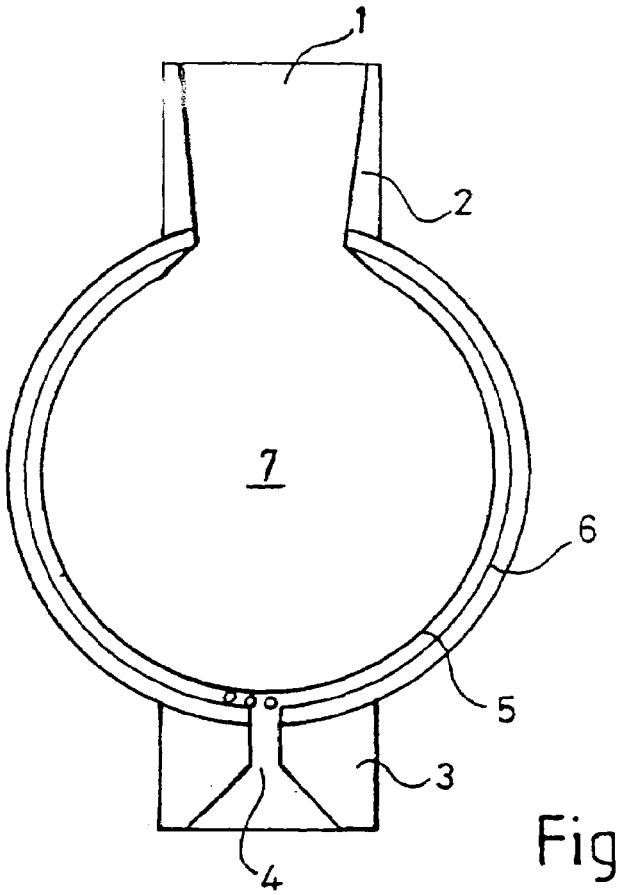
FIG. 3 shows a radial elevation of a capsule washing drum, through the central section A—A of the internal sleeve fine suction filter.

FIG. 3 discloses radial cross-section of the capsule washing drum through section A—A inside Item 7, wall of capsule Item 6, central filter sleeve Item 5, axial drive shafts Item 2 and 3, washing inlet Item 1, supply and vacuum inlet Item 4.

Figure 4:
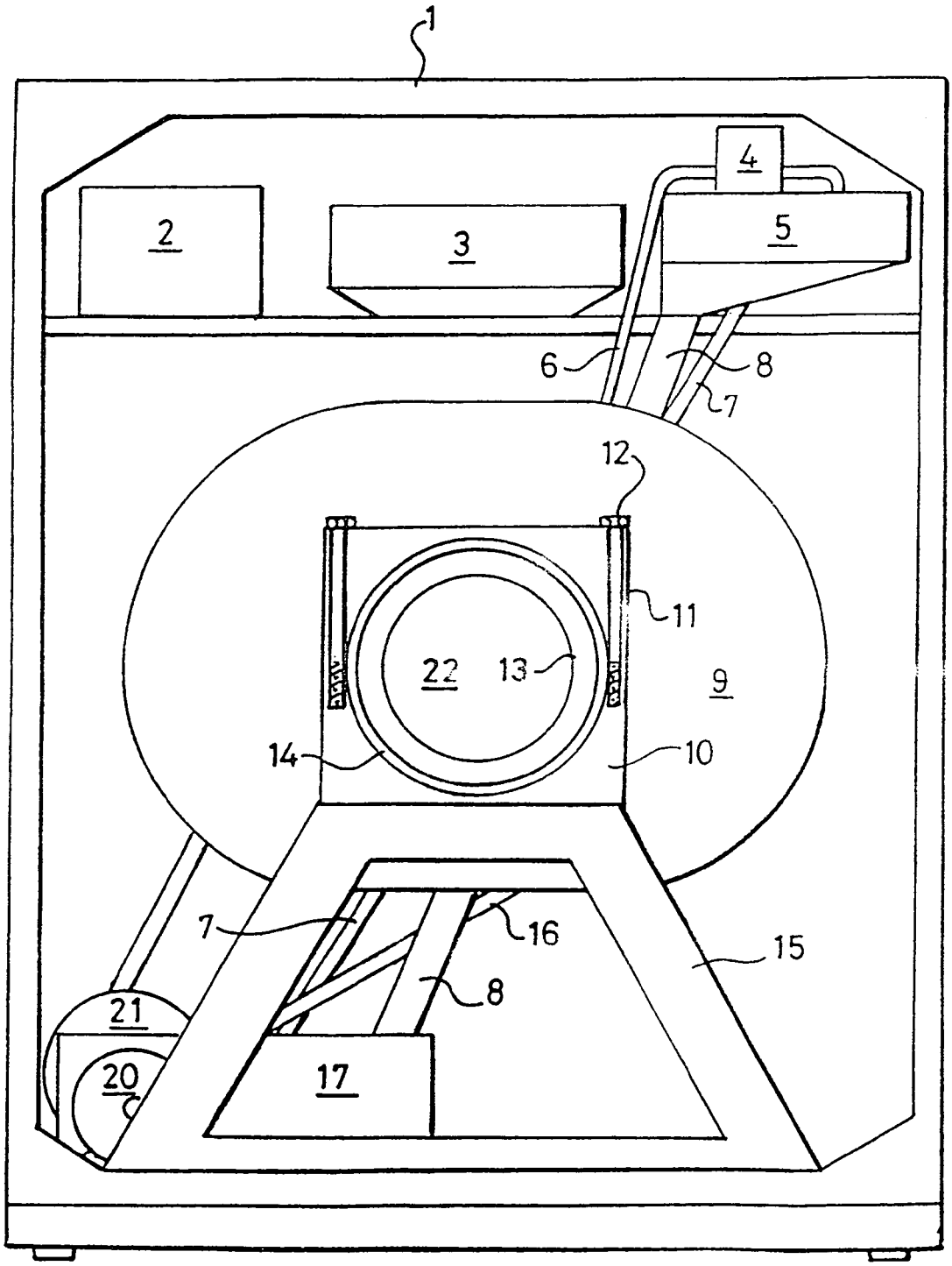
FIG. 4 shows a front elevation partially in section of a capsule washing drum machine.

FIG. 4 discloses a front elevation cross-section of a capsule washing drum machine showing cabinet frame Item 1, control panels Item 2 and 3, water supply inlet.

Item 4, detergent mixing drawer Item 5, supply tube to heater tank Item 8, cold water supply tube to drawer Item 6, capsule washing drum Item 9, bearing block Item 10 and 11, retaining bolts Item 12, bearing or bearing material Item 14, washing inlet Item 22, axial drive shaft Item 13, electrical cable Item 7, capsule support frame Item 15, heater tank Item 17, electric motor and pump Item 20, capsule drive motor Item 21, drive belt Item 16.

FIG. 5 discloses a rotary swivel joint showing suction port Item 17, stationary 90° inlet/outlet tube bend Item 7, rotary swivel fitted to the axial drive shaft on the capsule washing drum Item 10, male rotary body Item 9, female pin retainer Item 8, metal to metal outer seal Item 12, front seal Item 13 rear seal Item 16, central seal and retainer Item 11 and 14, bearing item 15.

FIG. 6 discloses a schematic front elevation partially in section of a venturi jet high vacuum pump with a centrifugal air pump controller, to control suction strength, showing high pressure water inlet Item 19, venturi inlet Item 4, venturi aperture Item 3, centrifugal air pump Item 1, air inlet Item 18, air chamber Item 2, peripheral air ducts Item 5, branch venturi inlet Item 6, to centre line of the 90° radius J/D tube bend Item 7.

FIG. 7 shows a schematic of a centrifugal pump Item 1, air inlet Item 18.

Figure 8:
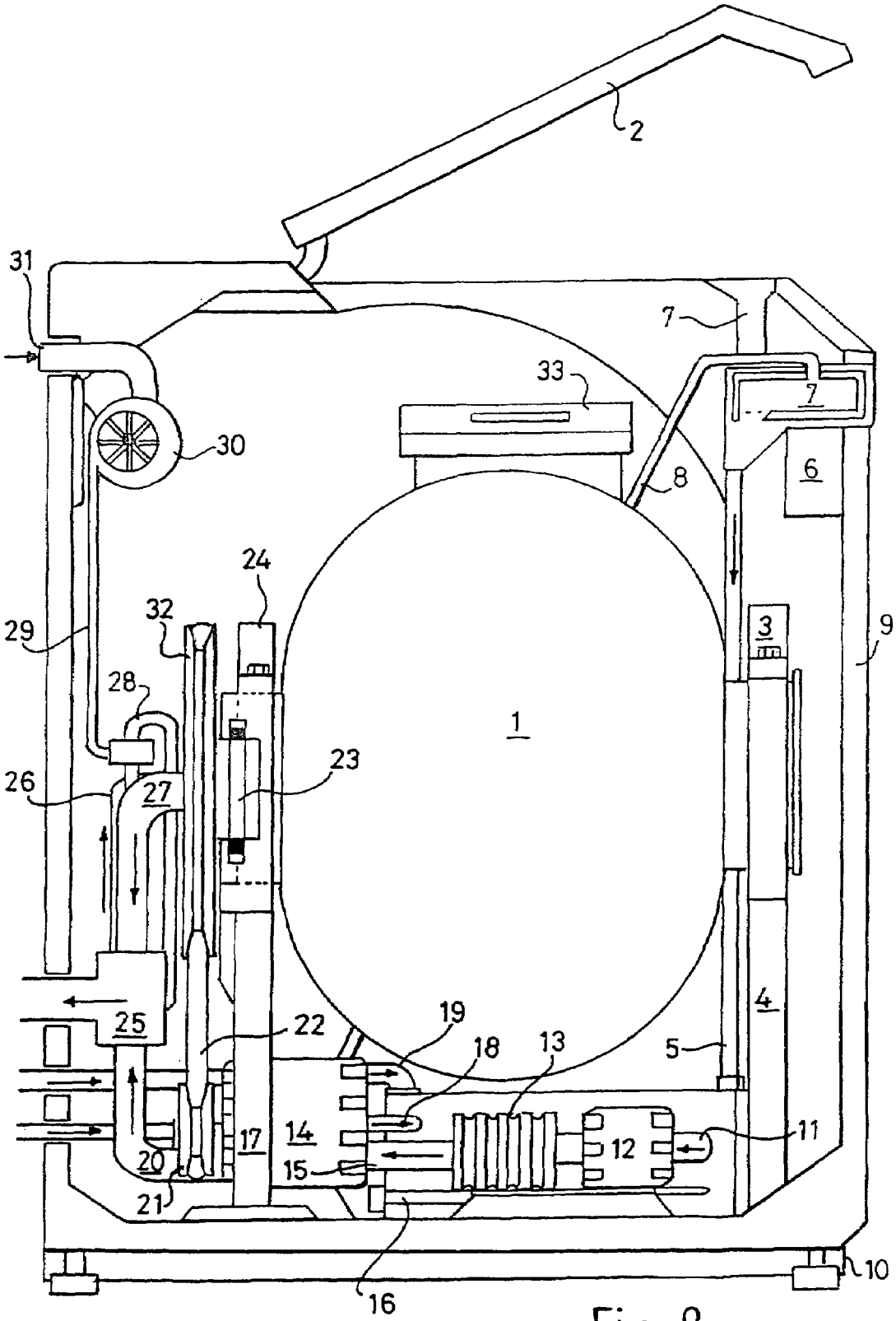
FIG. 8 shows a side elevation view partially in section of a capsule washing drum top loading machine.

FIG. 8 discloses a side elevation view partially in section of a top loading capsule washing drum machine showing outer cabinet shell Item 9, adjustable levelling feet Item 10, capsule washing drum item 1, press twist lock pressure cap Item 33, top loading door Item 2, rotary transparent glass door Item 2, bearing block retaining axial drive shafts item 3, and 24, support frame for capsule drive shafts Item 4, and 17, water and detergent supply tube to heater tank item 5, water heater Item 16, controls Item 6, detergent drawer Item 7, water supply to drawer Item 8, suction inlet to pump from heater tank Item 11, electric motor Item 12, drives water-detergent pump Item 13, water-detergent supply tube Item 15, 26, and 20, to control valve and drain outlet Item 25, for supply to the capsule washing drum through the solenoid valve rotary swivel joint Item 23, vacuum tube Item 27, venturi tube Item 28, air supply tube Item 29, centrifugal air motor/pump Item 30, air inlet to pump Item 31, electric drive motor and reduction gearing Item 14, motor drive pulley Item 21, capsule washing drum drive pulley Item 32, drive belt Item 22, hot water in Item 19, cold water in Item 18.

Figure 9:
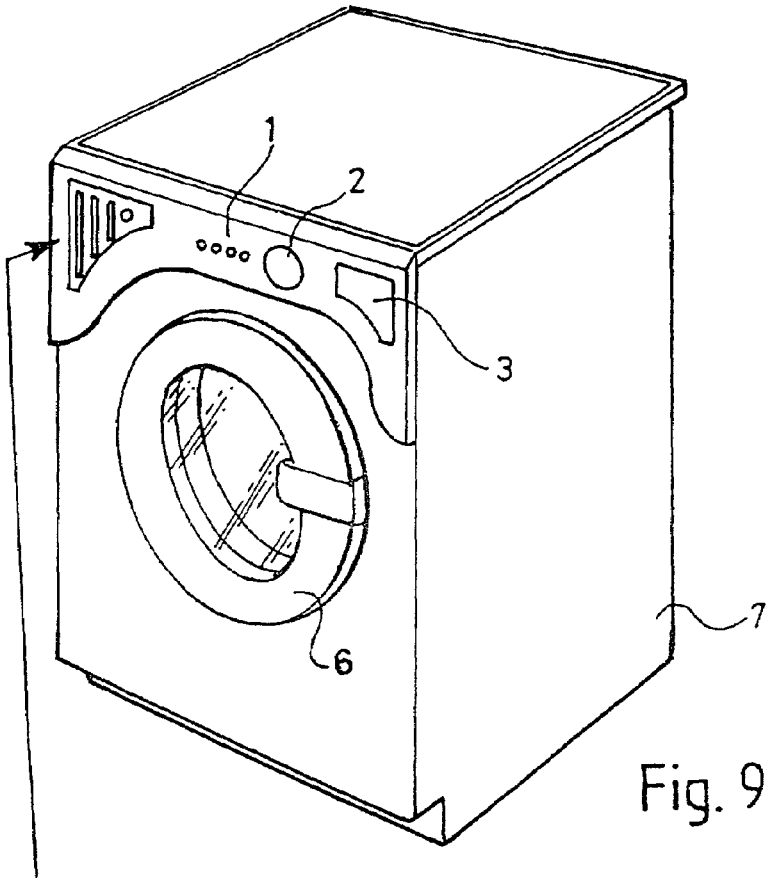
FIG. 9 shows a diagrammatic view of a pressure/vacuum capsule washing drum machine with controls.

FIG. 9 discloses a diagrammatic view of a pressure/vacuum capsule washing drum machine showing washing machine cabinet shell Item 7, dual loading door Item 6, and the controls Item 1, and 2, detergent loading drawer Item 3.

Figure 10:
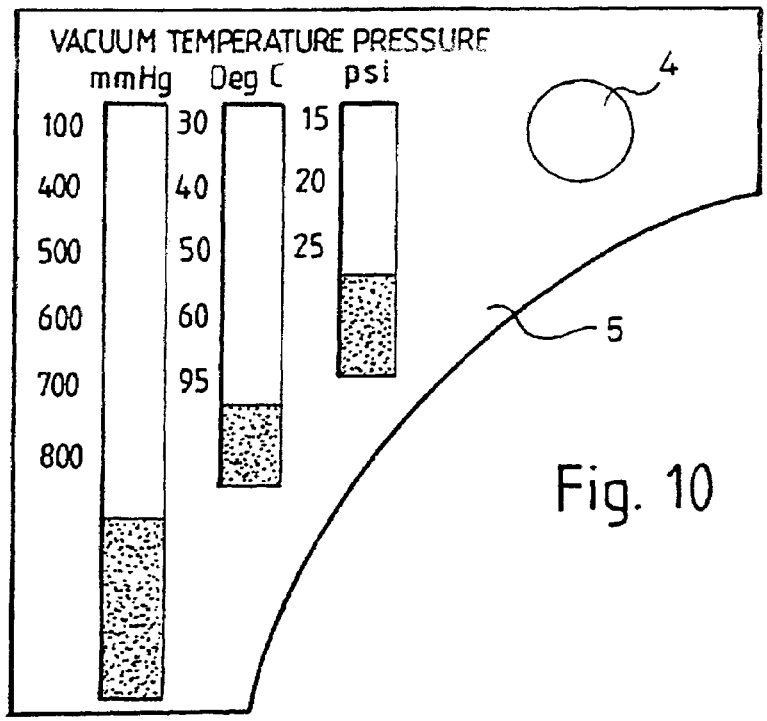
FIG. 10 shows a diagrammatic view of a front display panel.

FIG. 10 shows a diagrammatic view of a front panel display, (sample only) showing an LCD or glow bar indicators Item 5, control dial Item 4.

Figure 11:
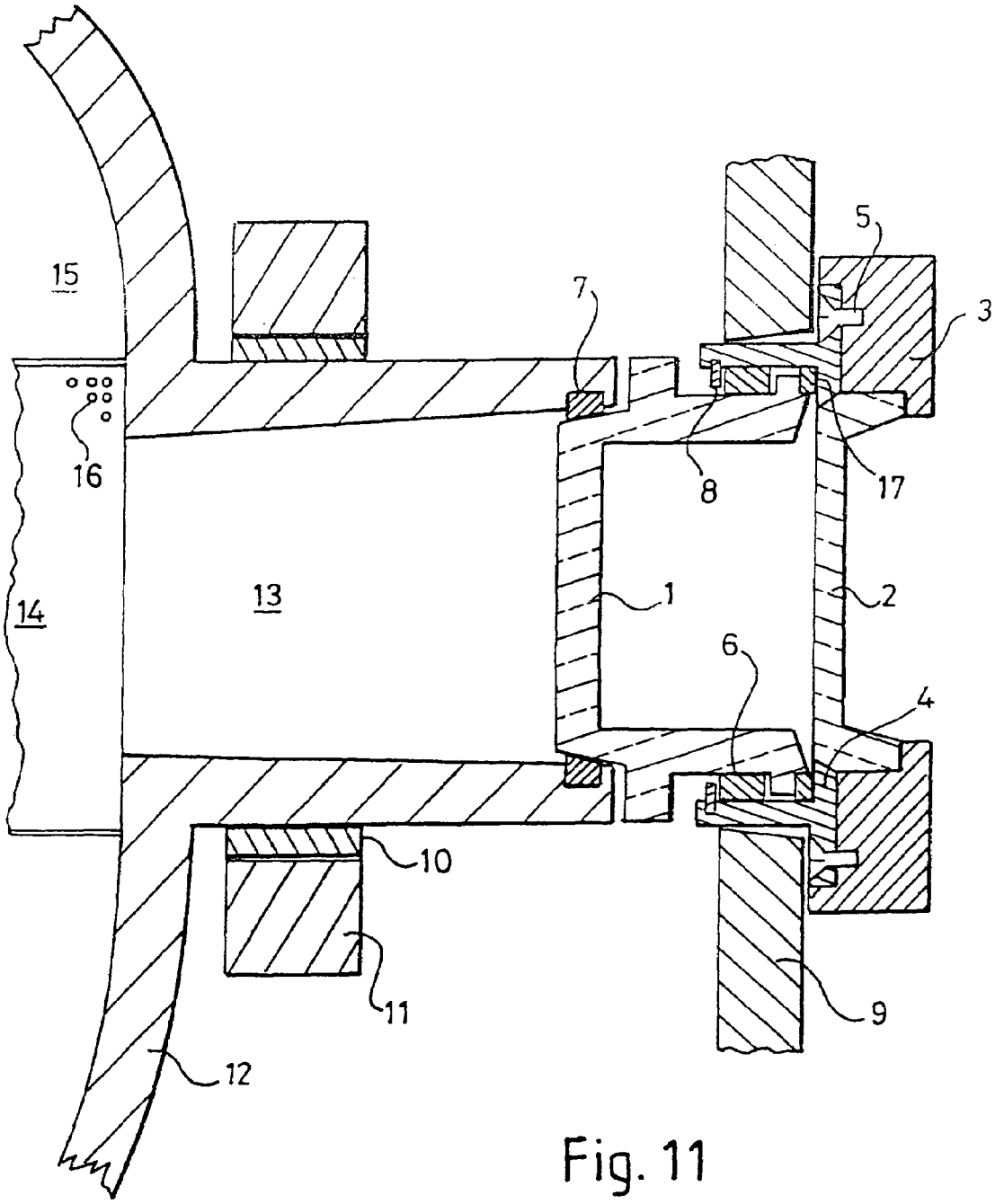
FIG. 11 shows a top elevation cross-section view of a glass transparent pressure/vacuum rotational sealing inner plug door and stationary transparent outer door.

FIG. 11 discloses cross-section elevation view of a dual transparent inner rotary plug door and stationary transparent outer door showing capsule wall Item 12, inside capsule Item 15, fine perforations Item 16, central filter screen sleeve Item 14 bearing item 10, bearing block Item 11, laundry loading port Item 13, pressure seals Item 7, outer cabinet shell Item 9, hinged door Item 3, hinge not shown transparent outer door Item 2, transparent inner door Item 1, bearing Item 6, retaining circlip Item 8, central dual door retaining unit Item 4, retaining countersunk screws Item 5, thrust pressure spring and backing rings Item 17.

Figure 12:
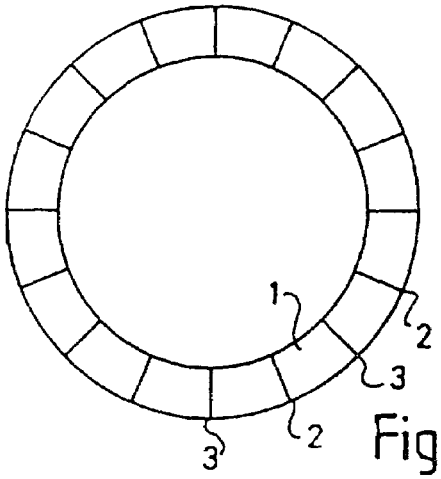
FIG. 12 shows an axial cross-section of a compression spring.

FIG. 12 discloses an axial cross-section of a circular sinuous or zig-zag type shape compression spring Item 1, with crests Item 3, and troughs Item 2. For applying continual pressure to the pressure seal around the laundry loading aperture with the dual inner door. For FIG. 11 Item 17.

Figure 12A:
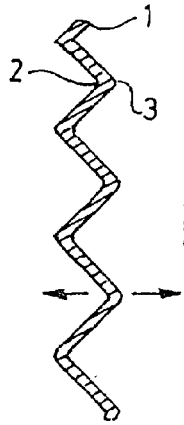
FIG. 12A shows a radial cross-section of FIG. 12.

FIG. 12A shows a radial cross-section of FIG. 12 that fits between the two thrust rings for retaining pressure on the inner door seal, FIG. 11, Item 7.

Figure 13:
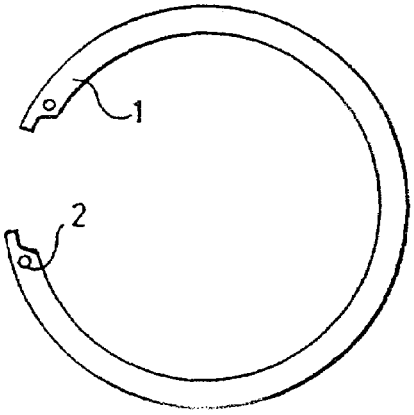
FIG. 13 shows a bearing circlip.

FIG. 13 shows a bearing retaining circlip Item 1, compression holes Item 2, for FIG. 11, Item 8.

Figure 14:
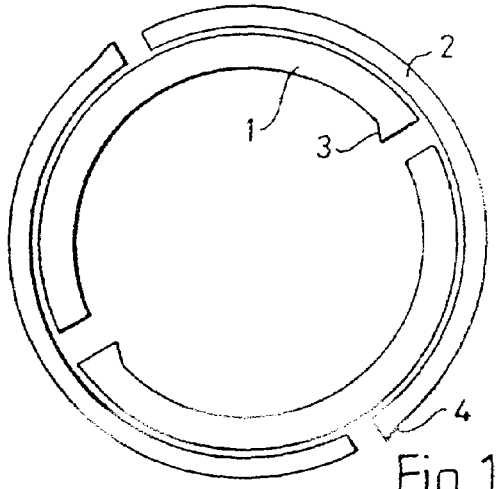
FIG. 14 shows two sets of split bearing shells.

FIG. 14 shows bearing shells inner Item 1, and outer Item 2, with anti-rotation lugs Item 3, and 4, for FIG. 11, Item 6.

Figure 15:
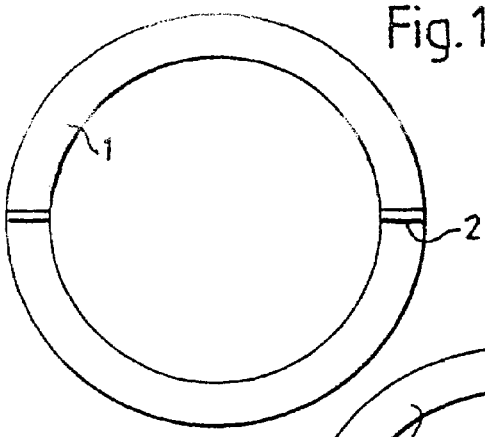
FIG. 15 shows a radial section of a backing ring.

FIG. 15 shows an axial section of a backing ring Item 1, with two anti-rotational kinks Item 2.

Figure 15A:
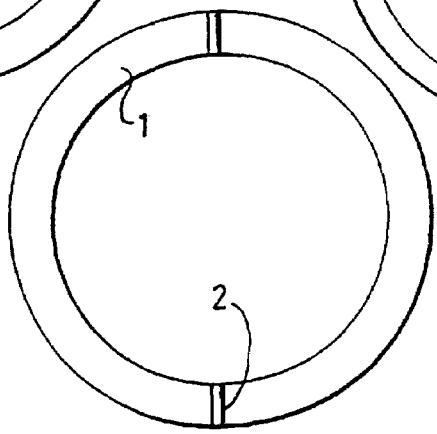
FIG. 15A shows an axial section of the opposite backing ring.

FIG. 15A shows an axial section of the opposite side backing ring Item 1 with anti-rotational kinks Item 2.

Figure 16:
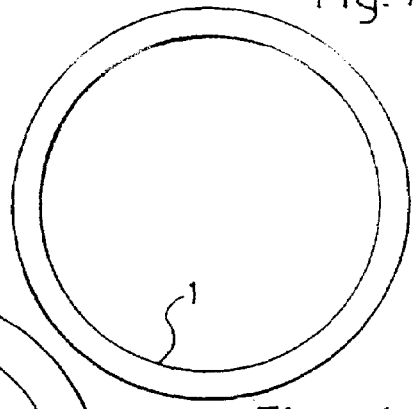
FIG. 16 shows an axial section of a thrust ring.

FIG. 16 shows an axial section of a friction thrust ring Item 1.

Figure 17:
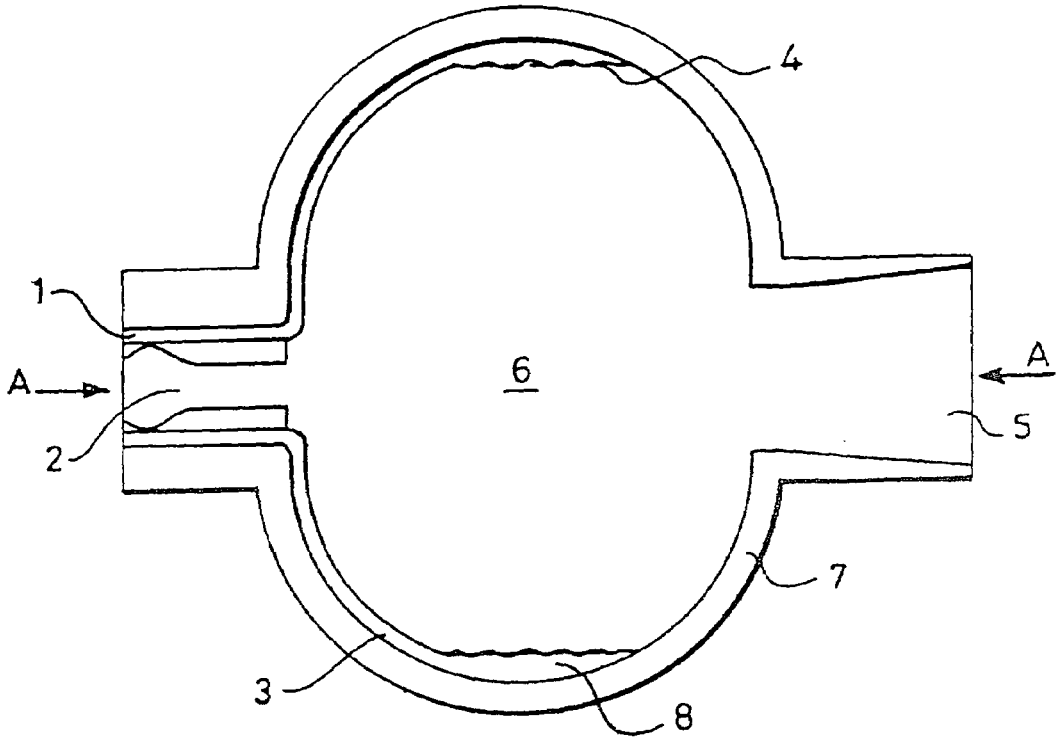
FIG. 17 shows a top longitudinal elevation view of a capsule washing drum.

FIG. 17 shows a top longitudinal elevation view partially in section of a capsule washing drum showing axial drive shaft side vacuum conduit Item 1, liquid inlet and outlet Item 2, vacuum inner conduit Item 3, wall of capsule Item 7, laundry inlet Item 5, capsule inner Item 6, sieve type filter screen Item 8, filter apertures Item 4.

Figure 18:
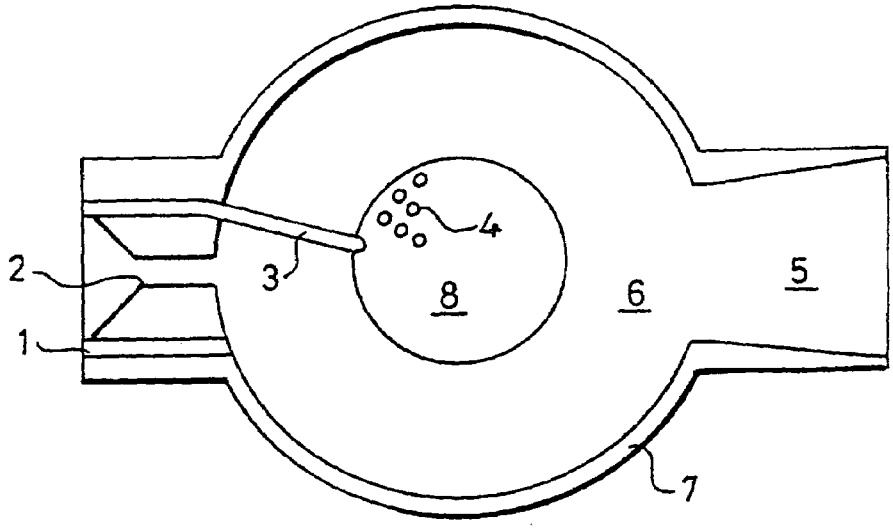
FIG. 18 shows a radial cross-section of a capsule washing drum.

FIG. 18 shows a radial cross-section of a capsule washing drum through section A—A inside Item 6, wall of capsule Item 7, sieve type filter screen item 8, fine filter apertures Item 4, vacuum conduit Item 3, vacuum duct Item 1, liquid inlet and outlet Item 2, laundry loading aperture Item 5.

Figure 19:
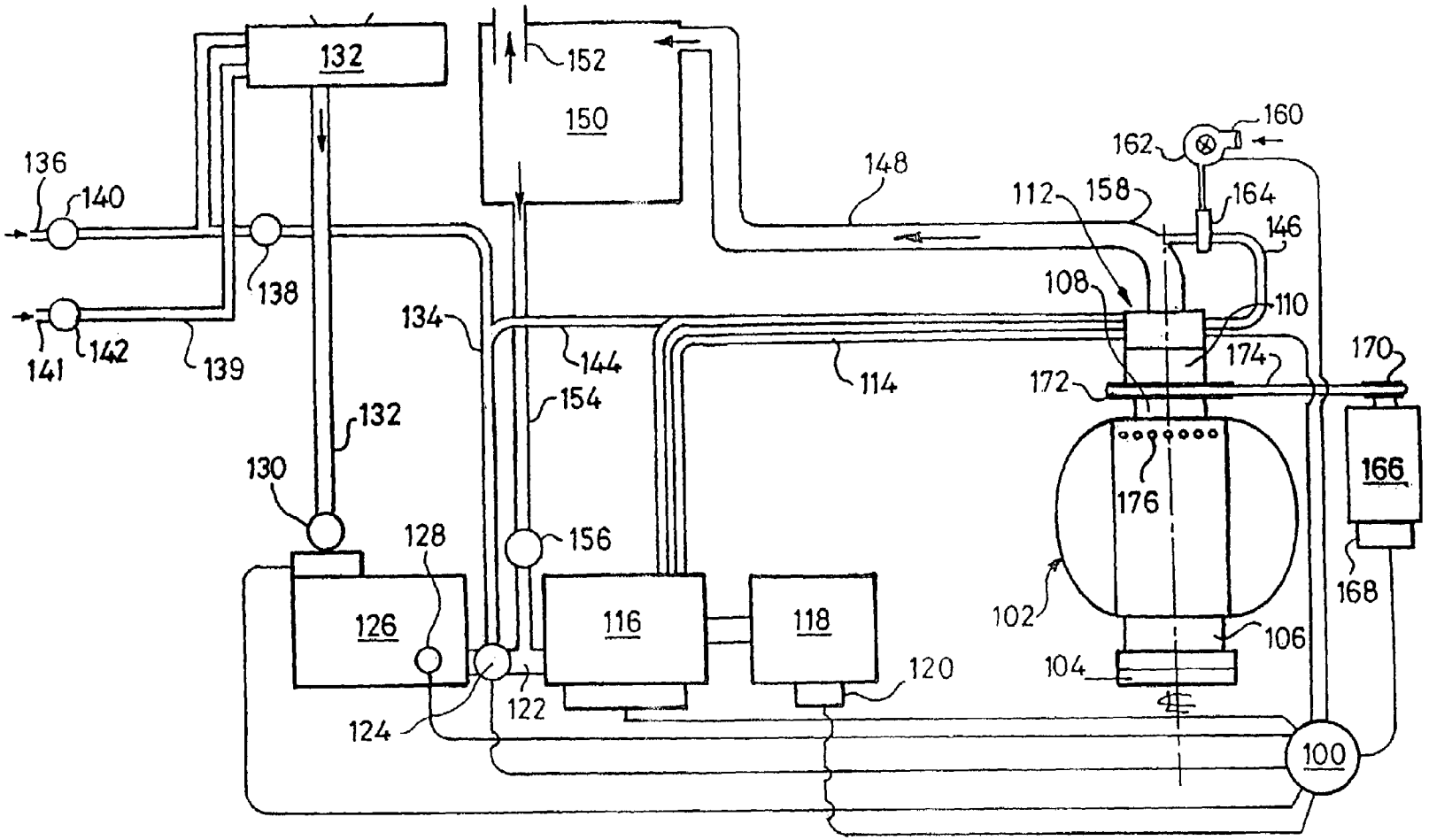
FIG. 19 is a schematic diagram of a pressure washing and vacuum driving machine.

FIG. 19 is a schematic diagram of a pressure washing and vacuum drying machine.

Operation of the pump drive motors, valves and capsule drive motor is effected by means of a programmable line computer (PLC) 100. A pressurised capsule 102 operating at between 15 to 20 psi is filled with a charge of articles to be washed, rinsed and dried through a circular opening (not shown) closed by a door 104 in front of a rotary bearing assembly 106, which supports the capsule at one end of its axis of rotation. A similar bearing assembly 108 supports the capsule at the other end of its axis of rotation and a rotary sealing joint 110 communicates between the interior of the capsule via the bearing assembly and a solenoid valve assembly 112.

The latter includes three valves for controlling the admission of a water and detergent mixture into the capsule, the extraction of fluid from the capsule and the delivery of fresh rinsing water to the capsule. To this end, one of the valves communicates with a pipe 114 leading from the outlet of a pump 116 (driven by a motor 118 having a motor control means 120), to which heated water and detergent are supplied via pipes 122, and solenoid valve 124 from a heating tank 126 containing an immersion heater 128 and supplied via solenoid valve 130 from pipe 132 from a detergent reservoir 132. Cold water is conveyed to the heating tank 126 via the solenoid valve 124 from pipe 134, itself connected to a cold water main 136 via solenoid valves 138 and 140. Pipe 139 is connected to a hot water main 141 via valve 142.

Cold water can be conveyed to the detergent reservoir 132 by opening 140 and closing 138, to flush detergent via pipes 132 and valve 130 into the heating tank 126.

Similarly hot water from 141 may be conveyed into and through the reservoir 132 by opening valve 142 and closing valves 138 and 140.

The pump 116 can supply cold water at 175 psi via pipes 144 to the 90 degree bend via bent pipe 146, from where it is exhausted via drain 148 to a sump 150. The latter includes an overflow 152 and a return pipe 154 which when valve 156 is open, provides a return for the water to the pump 116 from the venturi pump (not shown) formed in the 90 degree bend 158. For commercial/industrial applications, pump 116 will produce a higher pressure.

Air is admitted via an air inlet 160 and centrifugal air pump 162 and mixing device 164.

The speed of the air pump 162 is controlled by the PLC to control the suction generated by the venturi effect in the venturi pump 158.

At the end of a wash cycle and at the end of rinse cycle, water from the capsule is conveyed to the overflow or recirculated as described above.

The sump 156 is located in the base of a washing machine embodying the invention to assist in stabilising the machine when in use.

Washing

During a washing cycle, the capsule is rotated to tumble the articles by an electric motor 166 having a motor control 168, and drive is transmitted from the motor to the capsule via two pulleys 170,172 and an endless drive belt 174.

Water/detergent solution is pumped into the capsule at 175 psi through a plurality of 1–2 mm holes in a fine mesh filter plate 176. As shown in FIG. 19, the plate is at one end of the capsule perpendicular to the axis around which the capsule rotates.

Heating the water/detergent mixture to a sufficiently high temperature and forcing it through the fine mesh filter plate 176 into the capsule interior and maintaining the latter at a positive pressure significantly above ambient pressure, results in a two phase washing medium of liquid and steam which in combination with the partial vacuum created at the end of the washing cycle by the action of the venturi suction pump 158, has been found to effect a very efficient washing of articles in the capsule.

Rinsing

The rinse cycle may also be performed under positive pressure (ie above ambient) and the rinsing effect is seemingly enhanced by the partial vacuum created at the end of the rinse, by the action of the venturi pump 158.

Drying

Drying of the washed and rinsed articles is effected very efficiently by continuing to run the venturi pump 158 after all water has been sucked from the capsule, and the partial vacuum created in the capsule assists in evaporation of residual moisture for the articles.

The operation of the various solenoid valves, the time during which they are opened or closed and the intervals between operation thereof, are controlled by the PLC 100, which being programmable permits different washing and rinsing cycles to be performed, in the same way the PLC 100 controls the operation of the various electric motors such as 118, 162 and 166.

The invention claimed is:

1. A machine for washing articles comprising:

a sealable enclosure for containing articles to which washing liquid (including detergent and water) is to be supplied;

a heater tank and heater external to the enclosure, in which the washing liquid is heated to a high temperature;

a liquid pump by which the washing liquid is forced via a conduit pipe towards the enclosure under a pressure of the order of 175 psi (1.2 Mpa);

a fine mesh filter plate connected to the conduit pipe through which the washing liquid is forced to enter the enclosure, the filter plate having a plurality of small apertures of such a size as to produce finely dispersed or diffused droplets forming a mist or vapour, so that under the greater than atmospheric pressure in the enclosure the washing liquid droplets are forced into at least the surface of, if not through and into the very structure of, the material from which the articles are formed, so as to assist in the washing process;

means for replacing the washing liquid with rinsing water;

means for maintaining the pressure in the enclosure above atmospheric pressure during rinsing;

suction means for removing the washing liquid and the rinsing water from the articles and from the interior of the enclosure by suction, the suction means also being adapted to create a partial vacuum in the enclosure during drying of the articles after rinsing; and in which said suction means comprises a venturi suction pump for reducing the pressure in the enclosure below atmospheric pressure, and for assisting in drying of the articles after rinsing, and further comprising a sump to which water is conveyed and which includes a pipe for returning water to said liquid pump, whereby the water is conveyed to the sump after leaving the venturi pump for return to the liquid pump.

2. A machine as claimed in claim 1 wherein the sealable enclosure is in the form of an elliptical capsule mounted for rotation about an axis through the mid point of its longer axis perpendicular to the latter and comprising a diameter of the cylindrical mid-region.

3. A machine for washing articles comprising:

a sealable enclosure for containing articles to which washing liquid (including detergent and water) is to be supplied;

a heater tank and heater external to the enclosure, in which the washing liquid is heated to a high temperature;

a liquid pump by which the washing liquid is forced via a conduit pipe towards the enclosure under a pressure of the order of 175 psi (1.2 Mpa);

a fine mesh filter plate connected to the conduit pipe through which the washing liquid is forced to enter the enclosure, the filter plate having a plurality of small apertures of such a size as to produce finely dispersed or diffused droplets forming a mist or vapour, so that under the greater than atmospheric pressure in the enclosure the washing liquid droplets are forced into at least the surface of, if not through and into the very structure of, the material from which the articles are formed, so as to assist in the washing process;

means for replacing the washing liquid with rinsing water;

means for maintaining the pressure in the enclosure above atmospheric pressure during rinsing;

suction means for removing the washing liquid and the rinsing water from the articles and from the interior of the enclosure by suction, the suction means also being adapted to create a partial vacuum in the enclosure during drying of the articles after rinsing;

wherein the sealable enclosure is in the form of an elliptical capsule, having dome-shaped ends and a cylindrical mid-region, mounted for rotation about an axis through the mid point of its longer axis perpendicular to the latter and comprising a diameter of the cylindrical mid-region; and wherein each dome-shaped end is provided with a said filter plate and the washing liquid is forced through the two filter plates to enter the interior of the capsule from opposite ends thereof.

4. A machine for washing articles comprising:

a sealable enclosure for containing articles to which washing liquid (including detergent and water) is to be supplied;

a heater tank and heater external to the enclosure, in which the washing liquid is heated to a high temperature;

a liquid pump by which the washing liquid is forced via a conduit pipe towards the enclosure under a pressure of the order of 175 psi (1.2 Mpa);

a fine mesh filter plate connected to the conduit pipe through which the washing liquid is forced to enter the enclosure, the filter plate having a plurality of small apertures of such a size as to produce finely dispersed or diffused droplets forming a mist or vapour, so that under the greater than atmospheric pressure in the enclosure the washing liquid droplets are forced into at least the surface of, if not through and into the very structure of, the material from which the articles are formed, so as to assist in the washing process;

means for replacing the washing liquid with rinsing water;

means for maintaining the pressure in the enclosure above atmospheric pressure during rinsing;

suction means for removing the washing liquid and the rinsing water from the articles and from the interior of the enclosure by suction, the suction means also being adapted to create a partial vacuum in the enclosure during drying of the articles after rinsing;

wherein the sealable enclosure is in the form of an elliptical capsule, having dome-shaped ends and a cylindrical mid-region, mounted for rotation about an axis through the mid point of its longer axis perpendicular to the latter and comprising a diameter of the cylindrical mid-region; and wherein the filter plate is formed by a hollow cylindrical sleeve extending across the capsule co-axial with the axis of rotation of the capsule.

5. A machine for washing articles comprising:

a sealable enclosure for containing articles to which washing liquid (including detergent and water) is to be supplied;

a heater tank and heater external to the enclosure, in which the washing liquid is heated to a high temperature;

a liquid pump by which the washing liquid is forced via a conduit pipe towards the enclosure under a pressure of the order of 175 psi (1.2 Mpa);

a fine mesh filter plate connected to the conduit pipe through which the washing liquid is forced to enter the enclosure, the filter plate having a plurality of small apertures of such a size as to produce finely dispersed or diffused droplets forming a mist or vapour, so that under the greater than atmospheric pressure in the enclosure the washing liquid droplets are forced into at least the surface of, if not through and into the very structure of, the material from which the articles are formed, so as to assist in the washing process;

means for replacing the washing liquid with rinsing water;

means for maintaining the pressure in the enclosure above atmospheric pressure during rinsing;

suction means for removing the washing liquid and the rinsing water from the articles and from the interior of the enclosure by suction, the suction means also being adapted to create a partial vacuum in the enclosure during drying of the articles after rinsing;

wherein the sealable enclosure is in the form of an elliptical capsule, having dome-shaped ends and a cylindrical mid-region, mounted for rotation about an axis through the mid point of its longer axis perpendicular to the latter and comprising a diameter of the cylindrical mid-region; and wherein the filter plate is formed by a hollow cylindrical sleeve extending around the inner periphery of the cylindrical mid region.

* * * * *